United States Patent [19]

Liu

[11] Patent Number: 4,669,186

[45] Date of Patent: Jun. 2, 1987

[54] TWIN BLADED SURVIVAL KNIFE

[76] Inventor: Nan T. Liu, 140-42, Chu Lu Chien, Pao An Village, Jen Te Hsiang, Tainan Hsien, Taiwan

[21] Appl. No.: 744,011

[22] Filed: Jun. 12, 1985

[51] Int. Cl.[4] ..... B25B 1/08

[52] U.S. Cl. ..... 30/125; 30/299

[58] Field of Search ..... 30/123, 125, 299; 7/118, 119, 163, 164

[56] References Cited

U.S. PATENT DOCUMENTS

| | | | |
|---|---|---|---|
| 1,988,379 | 1/1935 | Gilles | 30/123 X |
| 2,507,019 | 5/1950 | Johnson | 30/299 X |
| 2,651,106 | 9/1953 | Breitzke | 30/125 |
| 2,681,505 | 6/1954 | Flanagan | 30/125 |
| 2,725,630 | 12/1955 | Warring | 30/299 |

*Primary Examiner*—E. R. Kazenske
*Assistant Examiner*—Michael D. Folkerts
*Attorney, Agent, or Firm*—Robert B. Frailey

[57] ABSTRACT

A twin bladed survival knife having a pair of knife blades and a hollow handle incorporating a plurality of separate compartments for containment of sundry survival objects. The knife has a secondary blade affixed to the handle and a hollow primary blade disposed telescopically over the secondary blade and connected releasably to the handle. A spring actuated, slidable detent disposed in the handle is operative to securely connect the primary blade to the handle and, upon being depressed, is operative to permit removal of the primary blade from the handle. The several compartments in the handle may contain a compass, a fishing reel, an electric light bulb and batteries for furnishing electric power to the bulb. A pivotal, longitudinally extending door on the handle provides access to at least some of the compartments in the handle. A hollow end cap is releasably affixed to the handle and includes one of the compartments as well as a lens for permitting visual access to the end cap compartment.

6 Claims, 5 Drawing Figures

TWIN BLADED SURVIVAL KNIFE

BACKGROUND OF THE INVENTION

Usually, during the difficulties of a field survival experience, the survivor can carry manually only a minimum of the essential equipment necessary to survive. A knife is one of the most essential tools for field survival. So, also, are a compass and a flashlight.

However, conventional knives usually have only a single blade, which may be either too large or too small to meet completely all the requirements of the field survival experience. It is impractical, of course, for one undergoing such an experience to be equipped with a full complement of knives or knife tools designed to serve a variety of different purposes. It also is difficult, if not impractical, for a person undergoing the survival experience to carry, as separate items of equipment, such survival objects as a compass, flashlight, fishing tackle, etc.

As far as the inventor is aware, there is not available, at the present time, a comprehensive, knife-like survival tool which is designed, in the form of a single tool, to contain and provide several different survival objects, including two knife blades of different size and/or character.

SUMMARY OF THE INVENTION

In view of the problem aforesaid, the inventor has conducted studies and trial experiments as a result of which he has developed, as a single tool, the twin bladed survival knife of this invention provided with primary and secondary knife blades. The secondary knife blade is affixed permanently to the knife handle, whereas the primary knife blade is connected releasably to the handle. The primary blade is hollow, and is designed to fit telescopically over the secondary blade for attachment to the handle. A spring biased, depressable detent element is operative to engage and securely connect the primary blade to the handle. Upon being depressed, the detent is operable to disengage from the primary blade to permit removal of the blade from the handle.

The handle of the knife of this invention is hollow, and is provided with several separate individual compartments for containment of sundry survival objects. The compartments, for example, may house a compass, a fishing reel, an electric light bulb and batteries for providing electric power thereto. The handle is provided with a longitudinally extending, pivotal door for providing access to one or more of the compartments disposed within the handle. The compartments in the handle accessed to by the door may include a gasket to ensure that, when the door is closed, the compartments are rendered water-tight.

The handle includes a detachably connected, hollow end cap which may have the compass mounted therein, and which may be provided with a lens for visual access thereto.

DETAILED DESCRIPTION OF THE PREFERRED EMBODIMENT

Figure 1:
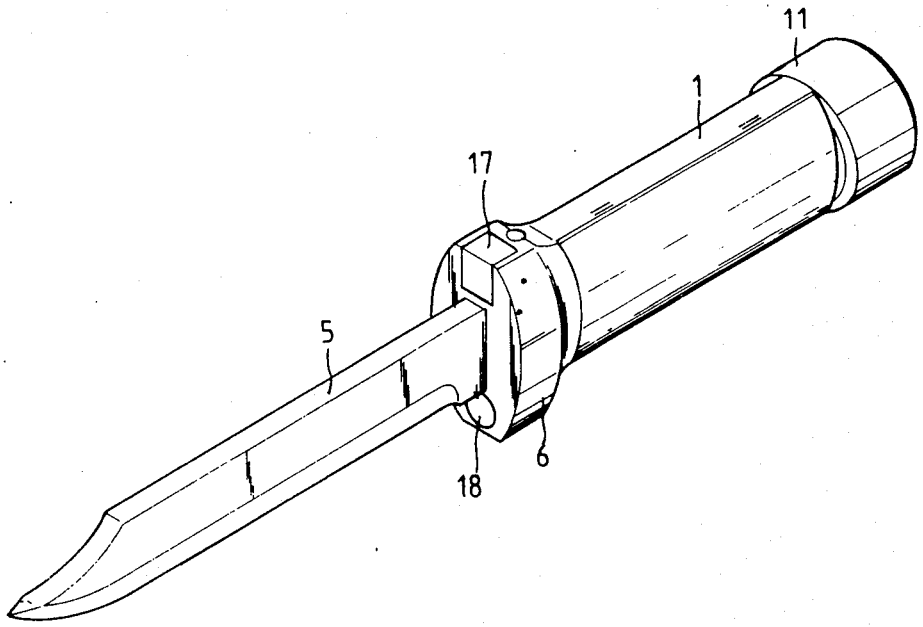
FIG. 1 is a perspective view of the twin bladed knife of the present invention.

In FIG. 1 there is illustrated the preferred embodiment of the knife of this invention having a hollow handle 1 and a hollow, releasably retained primary blade 5. The handle 1 includes a hollow, cup-shaped end cap 11 releasably attached at its outer end and has the usual finger guard 6 formed at its inner end. Finger guard 6 includes a compartment 17 for containment of an object, such as a fishing reel, and a compartment 18 for containment of an electric light bulb.

Figure 2:
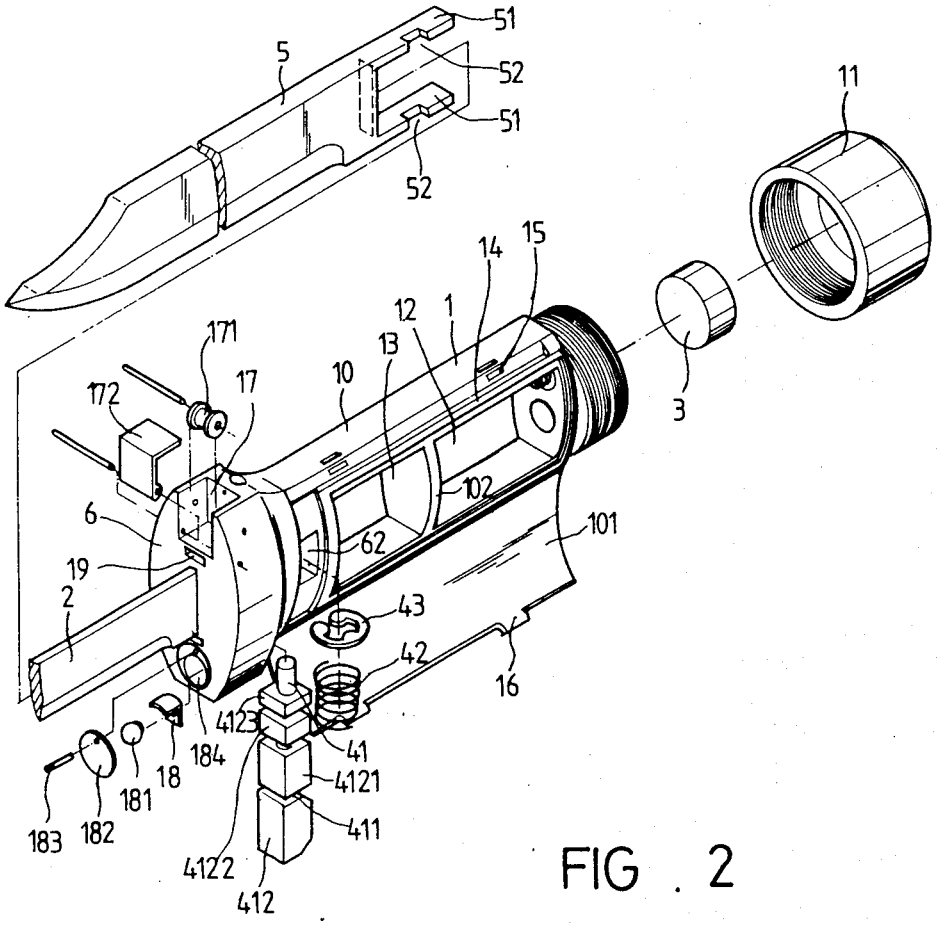
FIG. 2 is an exploded view of the invention.
Figure 3:
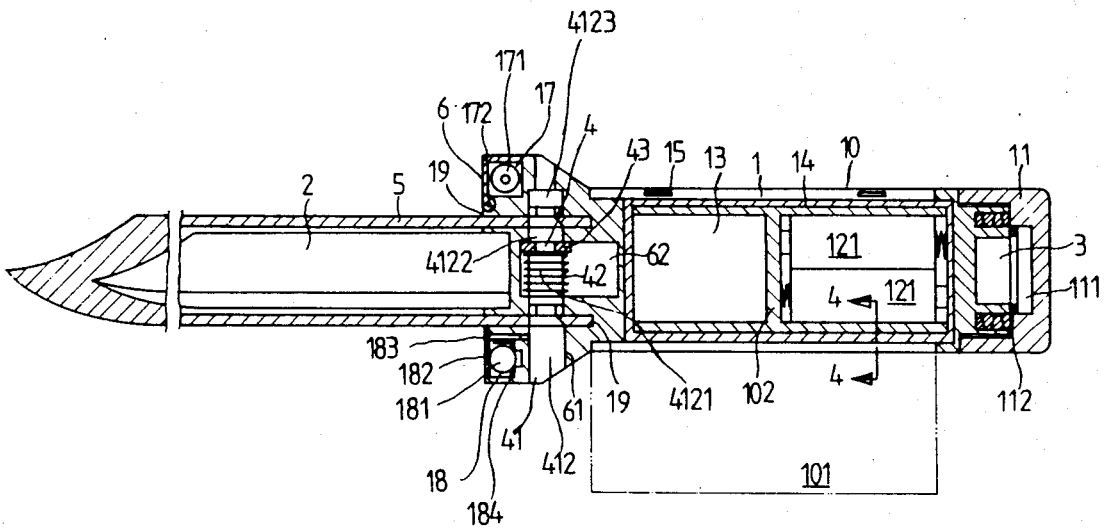
FIG. 3 is a cross sectional view of the invention in elevation.

FIGS. 2 and 3 illustrate the detail the novel structure of the twin bladed survival knife of this invention. Disposed internally of the hollow, releasably retained primary knife blade 5 is a secondary knife blade 2 integrally joined to the finger guard 6 of the handle 1. The hollow end cap 11 is provided with internal threads for engagement with corresponding threads formed externally of the outer end of the hollow handle 1. A compass 3 may be disposed in the hollow compartment of the end cap 11, and may be seen visually thhrough the transparent lens 111 mounted at the outer end of cap 11. A washer 112 is interposed internally of the end cap 11 between compass 3 and lens 111. The threaded arrangment between the handle 1 and its end cap 11 permits the ready removal of the lens 11 for use as a light reflector, if necessary or desired.

The portion of the knife handle 1 between finger guard 6 and end cap 11 is constituted of a hollow housing having a relatively fixed component 10 and a relatively pivotal door component 101. The two housing components 10, 101 are connected to each other by one or more longitudinally extending pivot pins (not shown) whereby door-like component 101 may be closed or opened pivotally relative to the fixed component 10. Longitudinally spaced convex lips 16 on door component 101 engage with correspondingly spaced concave holes 15 formed in fixed component 10 to ensure that the two housing components of handle 1 are secured in water-tight relationship when closed.

Formed interiorly of the handle 1 is a battery compartment 12 and a storage compartment 13, the two compartments being separated by a transverse wall 102. Compartment 12 is adapted to retain, in the usual manner, a pair of electric storage batteries 121. To ensure that the compartments 12, 13 are maintained water-tight, a suitable gasket 14 is disposed about the perimeters thereof. Access to the compartments 12, 13, of course, is through the longitudinally extending pivotal door 101 of the hollow housing of handle 1.

The hollow primary knife blade 5 is adapted to fit telescopically over the secondary knife blade 2. The blade 5 is detachably secured to the finger guard 6 of the handle 1 by means of a transversely extending, retractable detent 4. The retractable detent 4 is disposed slidably in a transverse bore 61 formed in the finger guard 6. Transverse bore 61 intersects a second, larger transverse bore 62 also formed in finger guard 6. The two intersecting transverse bores 61, 62 extend at right angles relative to each other, and are of rectangular cross section.

The slidable detent 4 comprises an elongated catch key 41 on which are disposed a succession of spaced, rectangular blocks 412, 4121, 4122, 4123 separated from each other by axially spaced grooves 411. A coil spring 42 is disposed around block 4121, and retained thereon by a C-shaped snap ring 43 disposed in the groove 411 intermediate blocks 4121 and 4122. Spring 42 urges the detent to the right, as viewed in FIG. 3, whereby block 4123, functioning as a stop, is urged into contact with an inner surface formed within the finger guard 6. The block 4121, spring 42 and snap ring 43 are all located within the transverse groove 62.

The rear end of the primary blade 5 is bifurcated and formed into a pair of transversely spaced, rearwardly extending plates 51 each having a notch 52 formed correspondingly in the edge thereof. The spaced, bifurcated plates 51, with their notches 52, are adapted to engage with the transverse detent 4 internally of the finger guard 6, whereby the primary blade 5 is releasably connected to the handle 1.

More specifically, there are formed in finger guard 6 a pair of transversely spaced, longitudinally extending slots 19 fashioned for the slidable reception of the spaced plates 51 of knife blade 5. Slots 19 extend inwardly of the finger guard 6 beyond the transverse bore 61 and straddle the transverse bore 62. When the detent 4 is pressed slidably to the left, as viewed in FIG. 3, to the position indicated in FIG. 5, the longitudinal slots 19 are aligned with the grooves 411 in detent 4 interposed between blocks 412, 4121 and blocks 4122, 4123. With the clearances thus provided, the spaced plates 51 of the primary blade 5 may be fully inserted into their corresponding slots 19, or may be readily removed therefrom.

Figure 5:
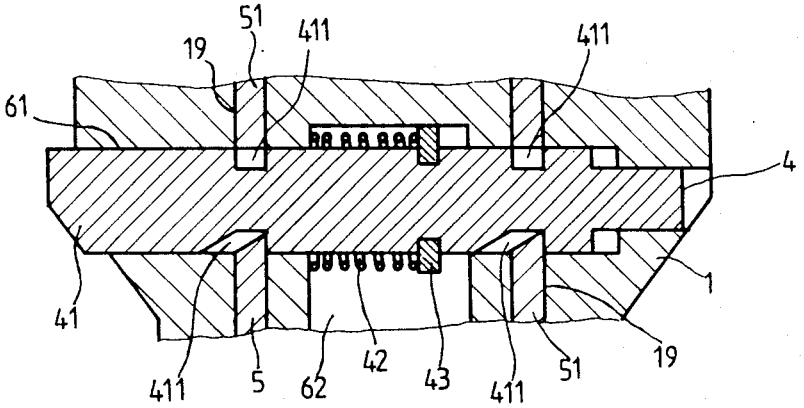
FIG. 5 is an enlarged fragmentary view in section of the detent for releasably retaining in the knife handle the primary knife blade of the invention.

After the knife blade plates 51 are fully inserted into their corresponding slots 19, the detent 4 may be released, whereupon the spring 42 restores the detent of its normal position. As a result, notches 52 of the knife blade plates 51 are engaged by the detent blocks 412, 4122, thereby securely locking the primary blade 5 into the finger guard 6 of the handle 1. Preferably, the innermost surfaces of blocks 412 and 4122 adjacent the clearance grooves 411 and the inner surfaces of knife notches 52 are beveled in a complementary manner (FIG. 5). Thus, when spring 42 restores detent 4 to its normal position as shown in FIG. 3, a camming action occurs between the complementally beveled surfaces of the blocks 412, 4122 and the notches 52, with the result that the plates 51 of the blade 5 are urged rearwardly into the finger guard 6 to tightly secure primary blade 5 in handle 1.

When it is desired to use the secondary blade 2, the detent 4 is depressed laterally to the left as viewed in FIG. 3 and the detent clearance grooves 411 are aligned with the plates 51, as illustrated in FIG. 5, whereupon the primary knife blade 5 may be easily extracted from the handle 1.

The compartment 17 preferably is disposed at the inner end of the handle 1 at the top of its finger guard 6, and has disposed therein a rotatable fishing reel 171 having a conventional fishing line (not shown) wound thereon. Compartment 17 may be provided with a pivotal, L-shaped cover 172 suitably mounted on a transversely extending pivot pin about which cover 172 may be pivoted to open or close compartment 17.

Figure 4:
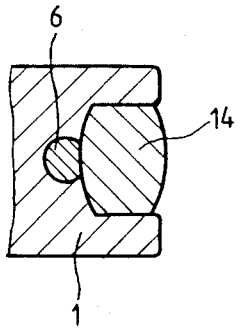
FIG. 4 is a sectional view looking in the direction of the angled arrows 4—4 of FIG. 3.

Bulb compartment 18 also is located at the inner end of the handle 1 in the bottom portion of the finger guard 6. Chamber 18 includes an electric light bulb 181, a round glass cover 182 and a longitudinally extending pin 183 for securing the cover 182 in place. The power supply for the bulb 181 is provided by the electric storage batteries 121 in the battery chamber 12. A pair of wire connectors 6 (FIG. 4), disposed below the gasket 14, transmit electric power from the batteries 121 to the bulb 181. Bulb 181, by reason of the location of bulb chamber 18, may provide lighting for cutting and preparing food at night, and also may serve as a light source for providing life saving signals at night.

I claim:

1. A twin bladed survival knife having a pair of knife blades and a hollow handle, said handle including an enlarged finger guard disposed adjacent said blades, comprising (a) a secondary blade affixed to the handle, (b) a hollow primary blade adapted to be disposed telescopically over the secondary blade and connected releasably to the handle, (c) notches disposed on the primary blade for connecting said blade to the interior of the handle, (d) retractable detent means disposed internally of the handle operable to engage the primary blade notches and securely connect the primary blade to the handle, (e) said detent means being movable to disengage said notches to permit removal of the primary blade from the handle, (f) a plurality of separate compartments disposed within the handle for containment of sundry survival objects, (g) a door mounted pivotally on the handle and extending longitudinally thereof, said pivotal door providing access to at least one of said storage compartments and (h) an end cap attached releasably to the handle at a location remote from the finger guard, said end cap including an interior compartment for containment of a survival object.

2. The knife of claim 1, further including:

(a) a compartment disposed in the finger guard for containment of an electric light bulb, (b) a bulb disposed in said compartment, (c) batteries disposed in one of said separate compartments aforesaid, said battery compartment being accessed to by means of the pivotal door aforesaid, and (d) electric conductors connecting said batteries to said bulb to provide electric power thereto.

3. The knife of claim 1 further including a compartment disposed in the finger guard for containment of a rotatable fishing reel, said compartment includng a pivotal closure for closing said compartment.

4. The knife of claim 1 further including a compass disposed in the interior compartment of the end cap.

5. The knife of claim 1 having at least five of said separate compartments including (a) a compartment for containment of a compass, (b) a compartment for containment of a fishing reel, (c) a compartment for containment of an electric light bulb and (d) a compartment for containment of electric storage batteries.

6. The knife of claim 1 wherein (a) the primary blade is insertable into and removable from the handle in a direction longitudinally of the handle and (b) the retractable detent is disposed transversely of the knife handle within the enlarged finger guard thereof, (c) said detent being spring biased and slidable laterally relative to the primary blade.

* * * * *